United States Patent [19]

Eto et al.

[11] Patent Number: 4,993,927

[45] Date of Patent: Feb. 19, 1991

[54] SCROLL FLUID MACHINE WITH LUBRICATION OF OLDHAM COUPLING

[75] Inventors: Isamu Eto; Mitsuhiro Nishida, both of Fukuoka, Japan

[73] Assignee: Mitsubishi Denki Kabushiki Kaisha, Tokyo, Japan

[21] Appl. No.: 344,350

[22] Filed: Apr. 28, 1989

[30] Foreign Application Priority Data

Jun. 3, 1988 [JP] Japan ..... 63-74440[U]
Jun. 7, 1988 [JP] Japan ..... 63-141065
Jul. 26, 1988 [JP] Japan ..... 63-187691

[51] Int. Cl.[5] ..... F04C 18/04; F04C 29/02

[52] U.S. Cl. ..... 418/55.3; 418/55.6; 418/188

[58] Field of Search ..... 418/55 B, 55 E, 188

[56] References Cited

U.S. PATENT DOCUMENTS 4,762,477 8/1988 Hayand et al. ..... 418/55 E
4,846,640 7/1989 Nishida et al. ..... 418/55 E

FOREIGN PATENT DOCUMENTS 55-46081 3/1980 Japan .
57-76292 5/1982 Japan ..... 418/55 E
63-80089 4/1988 Japan .
64-302 1/1989 Japan .
64-24191 1/1989 Japan .

*Primary Examiner*—John J. Vrablik
*Attorney, Agent, or Firm*—Sughrue, Mion, Zinn, Macpeak & Seas

[57] ABSTRACT

A scroll fluid machine comprising an upper and a lower scrolls provided in and upper and a lower positions, respectively, in a casing and supported eccentrically to each other; a coupling whose central member is provided under the lower scroll and whose peripheral member is provided at the upper scroll and conjoined to the central member; and a shallow oil storage recess provided at the bottom of the inside of the casing near the central member and facing the central member.

6 Claims, 2 Drawing Sheets

SCROLL FLUID MACHINE WITH LUBRICATION OF OLDHAM COUPLING

BACKGROUND OF THE INVENTION

The present invention relates to an improved scroll fluid machine such as a scroll vacuum pump of the overall rotation type.

FIG. 1 shows a longitudinally sectional view of a conventional scroll fluid machine disclosed in the Japanese Patent Application (OPI) No. 46081/80 (the term "OPI" as used herein means an "unexamined published application") and comprising a casing 1, an electric motor 2, a rib 3, a bearing holder 4, a fixed scroll 5, a rotary scroll 6, a gas intake port 7, a gas discharge port 8, and oil return holes 9. The casing 1 contains lubricating oil 10 at the bottom of the casing. The motor 2 is provided in the casing 1 and has a rotary shaft 2*a* having an oil passage 2*b* extending through the shaft in the axial direction thereof and open in the lubricating oil 10. The rib 3 is coupled to the inside surface of the casing 1. The bearing holder 4 is coupled to the rib 3 and supports the rotary shaft 2*a* rotatably. The fixed scroll 5 is coupled to the bearing holder 4. The rotary scroll 6 is eccentrically rotated by the rotary shaft 2*a* relative to the fixed scroll 5. The gas intake port 7 communicates with the internal opening of the fixed scroll 5. A gas compressed by the fixed and the rotary scrolls 5 and 6 is discharged from the casing 1 through the gas discharge port 8. The oil return holes 9 vertically extend through the rib 3 to return the lubricating oil down from over the bearing holder 4. When the electric motor 2 is rotated, the rotary scroll 6 is revolved so that the gas is introduced into the casing 1 through the gas intake port 7, compressed by both the scrolls 5 and 6 and discharged form the casing 1 through the gas outlet port 8. At that time, the lubricating oil 10 stored in the casing 1 at the bottom thereof is supplied to the scrolls 5 and 6 through the oil passage 2*b* due to a pressure difference in the casing, lubricates the sliding portions of the scroll fluid machine, and is returned to the bottom of the casing through the oil return holes 9. The machine can thus be used as a vacuum pump. However, since the oil passage 2*b* is provided in the rotary shaft 2 to use the lubricating oil 10 to lubricate a bearing, a coupling and so forth and prevent the gas from leaking through a small clearance, the constitution of the scroll fluid machine is complicated. This is a problem. Besides, dust or chips generated as a result of the wear of the machine and deposited on the bottom of he inside of the body of the machine is agitated together with the lubricating oil 10 so as to be moved to the sliding portions of the machine to promote the wear thereof. This is another problem.7

SUMMARY OF THE INVENTION

The present invention was made in order to solve the above mentioned problems.

Accordingly, it is an object of the present invention to provide a scroll fluid machine in which a coupling can be easily and surely lubricated through a simple construction.

The machine comprises an upper and a lower scrolls provided in an upper and a lower positions, respectively, in a casing, a coupling whose central member is provided under the lower scroll and whose peripheral member is provided at the upper scroll and conjoined to the central member, and a shallow oil storage recess provided at the bottom of the inside of the casing. The lubricating oil in the shallow oil storage recess is waved due to the rotation of the coupling so as to lubricate it.

It is another object of the present invention to provide a scroll fluid machine in which dust or chips generated as a result of the wear of the machine and contained in lubricating oil are surely and stably deposited down not to promote the wear.

The machine comprising a driving and a driven scrolls provided in an upper and a lower positions, respectively, in a casing and supported eccentrically to each other; a coupling whose central member is provided under the driven scroll and whose peripheral member is provided at the driving scroll and conjoined to the central member; an annular wall extending up from the bottom of the inside of the casing and located near the central member; an oil storage recess provided at the bottom of the inside of the casing near the central member and located inside the annular wall; an oil sump deeper than the oil storage recess, provided outside the annular wall and communicating with the recess through an oil passage; and an annular guide projection extending down from the bottom of the peripheral member into the oil sump. Since the annular guide projection is located near the central member of the coupling, lubricating oil in the oil storage recess is prevented from being moved away directly to the inside circumferential surface of the casing. For that reason, the central and peripheral members of the coupling are surely lubricated. When the oil in the oil storage recess is moved away to the oil sump due to the rotation of the driven scroll, the level of the oil in the oil sump becomes higher than that of the oil in the recess so that the oil circulates through the sump, the oil passage and the recess. For that reason, the oil is surely supplied back from the sump to the recess. Since the annular guide projection extends down from the bottom of the peripheral member of the coupling into the oil sump the oil coming to the projection over the annular wall is prevented from being moved away directly to the inside circumferential surface of the casing but is guided downward by the projection so that the oil surely circulates through the oil storage recess, the oil sump and the oil passage. For that reason, the central and peripheral members of the coupling are more surely lubricated.

It is yet another object of the present invention to provide a scroll fluid machine comprising an upper and a lower scrolls provided in an upper and a lower positions, respectively, in a casing and supported eccentrically to each other; an Oldham coupling which connects the scrolls to each other; an oil sump provided at the peripheral portion of the bottom of the inside of the casing.

It is still yet another object of the present invention to provide a scroll fluid machine comprising an upper and a lower scroll provided in an upper and a lower position, respectively, in a casing and supported eccentrically to each other; an Oldham coupling which connects the scrolls to each other; an oil sump provided at the peripheral portion of the bottom of the inside of the casing; an opening defined between the bottom of the casing and a bearing means by which the lower scroll is rotatably supported; and an oil passage through which the opening and the oil sump communicate with each other.

Lubricating oil moved away to the inside circumferential surface of the casing due to the rotation of the Oldham coupling drops down together with dust or chips generated as a result of the wear of the machine, so that the dust or chips deposit in the oil sump and the oil circulates through the sump, the oil passage and the opening surely lubricate the Oldham coupling and the bearing means. Besides, the oil in the oil sump can be easily replaced with new lubricating oil.

DETAILED DESCRIPTION OF EXEMPLARY EMBODIMENTS

Embodiments of the present invention is hereafter described in detail with reference to the drawings attached hereto.

Figure 2:
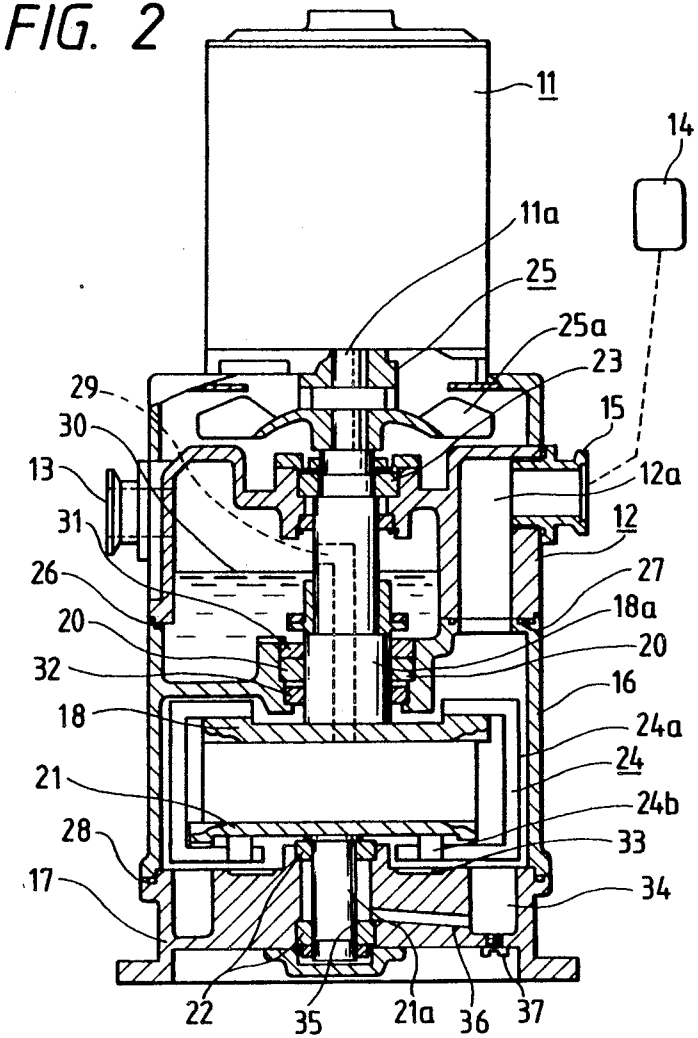
FIG. 2 shows a longitudinally sectional view of a scroll fluid machine which is an embodiment of the present invention.
Figure 1:
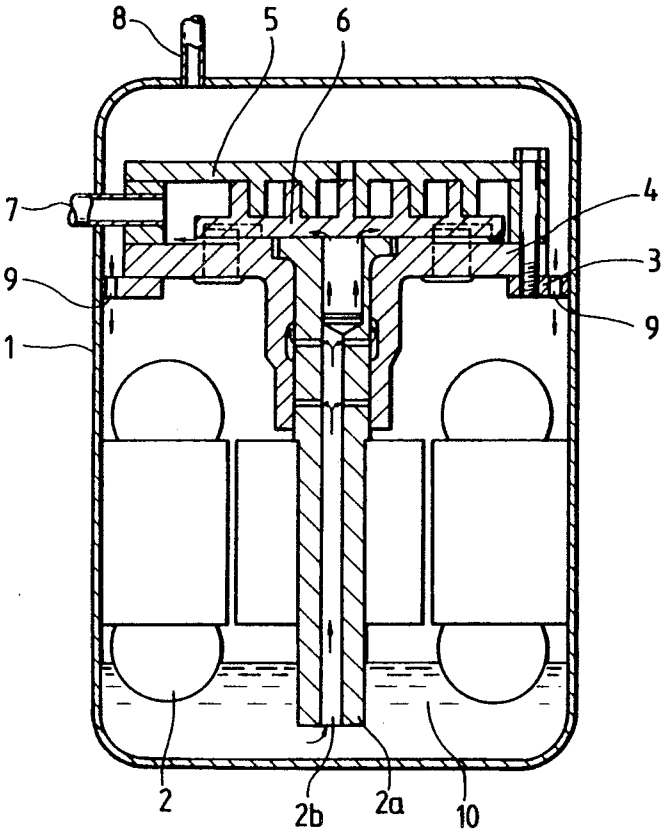
FIG. 1 PRIOR ART
FIG. 1 shows a longitudinally sectional view of a conventional scroll fluid machine.

FIG. 2 shows a scroll fluid machine which is one of the embodiments. The machine comprises an electric motor 11, an upper casing 12, a gas discharge port 13, a gas intake port 15, a vertical gas intake passage 12*a*, a lower casing 16, a base 17, a driving scroll 18, a driven scroll 21, an Oldham coupling 24, a joint 25, O-rings 26, 27 and 28, a gas discharge passage 29, oil seals 31 and 32, an annular oil storage recess 33, an oil sump 34, an opening 35, an oblique oil passage 36, and an oil drain plug 37. The motor 11 has a rotary shaft 11*a* projecting down from the body of the motor. The upper casing 12 is coupled to the electric motor 11. The gas discharge port 13 is open into the upper portion of the upper casing 12. The gas intake port 15 is open into the upper portion of the upper casing 12 opposite the gas intake port 15 and communicates with a vacuum container 14. The vertical gas intake passage 12*a* communicates at the upper end thereof with the gas intake port 15 and is open at the lower end of the passage. The lower casing 16 is coupled at the top thereof to the bottom of the upper casing 12. The base 17 is coupled at the top thereof to the bottom of the lower casing 16. The driving scroll 18 is provided in the lower casing 16 and has a shaft 18*a* rotatably supported with bearings 20 and 23 on the lower and the upper casings 16 and 12 and projecting from the upper casing. The driven scroll 21 is provided in the lower casing 16 so as to cooperate with the driving scroll 18 and has a shaft 21*a* rotatably supported with bearing 22 on the base 17 eccentrically to the driving scroll. The Oldham coupling 24 connects the driving and the driven scrolls 18 and 21 to each other so that the scrolls are rotatable. The coupling 24 includes a peripheral member 24*a* conjoined to the scroll 18, a peripheral member (not shown) conjoined to the driven scroll 21, and a central member 24*b* adjacent to the driven scroll, the peripheral members having portions at right angles to each other which are slidably mounted in the central member as is well known in the art. The joint 25 connects the rotary shaft 11*a* and the shaft 18*a* to each other and is integrally formed with a fan 25*a*. The O-ring 26 seals the upper and the lower casings 12 and 16 between them. The O-ring 27 seals the gas intake passage 12*a* from the interior of the upper casing 12. The O-ring 28 seals the lower casing 16 and the base 17 between them. The gas discharge passage 29 is provided in the shaft 18*a* and open at the upper end of the passage over the surface of lubricating oil 30. The oil seals 31 and 32 seal the opening defined between the upper and the lower casings 12 and 16. The oil storage recess 33 is shallowly provided in the top of the base 17 and faces the central member 24*b* of the Oldham coupling 24 near the member. The oil sump 34 is provided in the base 17 more deeply than the oil storage recess 33 and located around it. The opening 35 is defined between the bearings 22. The oil passage 36 connects the opening 35 and the oil sump 34 to each other in such a manner that the end of the oil passage at the opening is higher than that of the other end of the passage at the oil sump. The oil drain plug 37 is provided for draining the lubricating oil 30 from the oil sump 34.

When the motor 11 is rotated, the driving scroll 18 is rotated and the driven scroll 21 is eccentrically rotated through the action of the Oldham coupling 24 so that the gas is compressed by scrolls and discharged to the upper casing 12 through the gas discharge passage 29 while the gas is sucked out of the vacuum container 14 into the scrolls through the gas intake port 15, the gas intake passage 12*a* and the lower casing 16. At that time, the gas in the upper casing 12 is discharged from the machine through the gas discharge port 13. The lubricating oil 30 in an oil tank composed of the upper casing 12 and the upper portion of the lower casing 16 is supplied in between the scrolls 18 and 21 by an automatic oil feeder not shown in the drawing, so that the oil performs lubrication and sealing. Some of the lubricating oil 30 supplied in between the scrolls 18 and 21 is drained together with the gas through the gas discharge passage 29, while the other of the oil remains in the lower casing 16 and lubricates the Oldham coupling 24 and the bearings 22.

When the amount of the lubricating oil 30 in the lower casing 16 has increased, the oil is partly sucked to the scrolls 18 and 21 so that the oil is usually kept at such a prescribed quantity as to slightly dip the Oldham coupling 24. Throughout the operation of the machine, the lubricating oil in the lower casing 16 is agitated and flown away outward in the circumferential direction thereof by the Oldham coupling 24 so that the interior of the lower casing is filed with oil drops, and an oil film clinging to the inside surface of the lower casing flows down thereon and accumulates in the lower portion thereof. Since the gas intake passage 12*a* extends vertically, oil drops flown away upward do not reach the gas intake port 15 but go down. The surface of the lubricating oil 30 remaining in the shallow oil storage recess 33 is waved due to the rotation of the Oldham coupling 24 so that the tops of the waves of the oil come into contact with the coupling and lubricate the sliding portions of the central and peripheral members 24*b* and 24*a* of the coupling. In other words, since the oil storage recess 33 is shallow, the lubricating oil 30 therein is easily agitated and waved. Since the total amount of the lubricating oil 30 in the machine is relatively small, the amount can be easily secured.

Since the oil sump 34 deeper than the oil storage recess 33 is provided around the latter, dust or chips generated as a result of the wear of the moving portions of the scroll fluid machine and contained in the lubricating oil 30 flown away outward in the circumferential direction of the machine deposit in the oil sump. The deposited dust or chips can be removed from the machine by detaching the oil drain plug 37. Since the opening 35 between the bearings 22 communicates with the oil sump 34 through the oil passage 36, a deposit in the opening can be also removed from the machine through the oil sump. Besides, new lubricating oil can be introduced into the opening 35 when the lubricating oil 30 is replaced.

Figure 3:
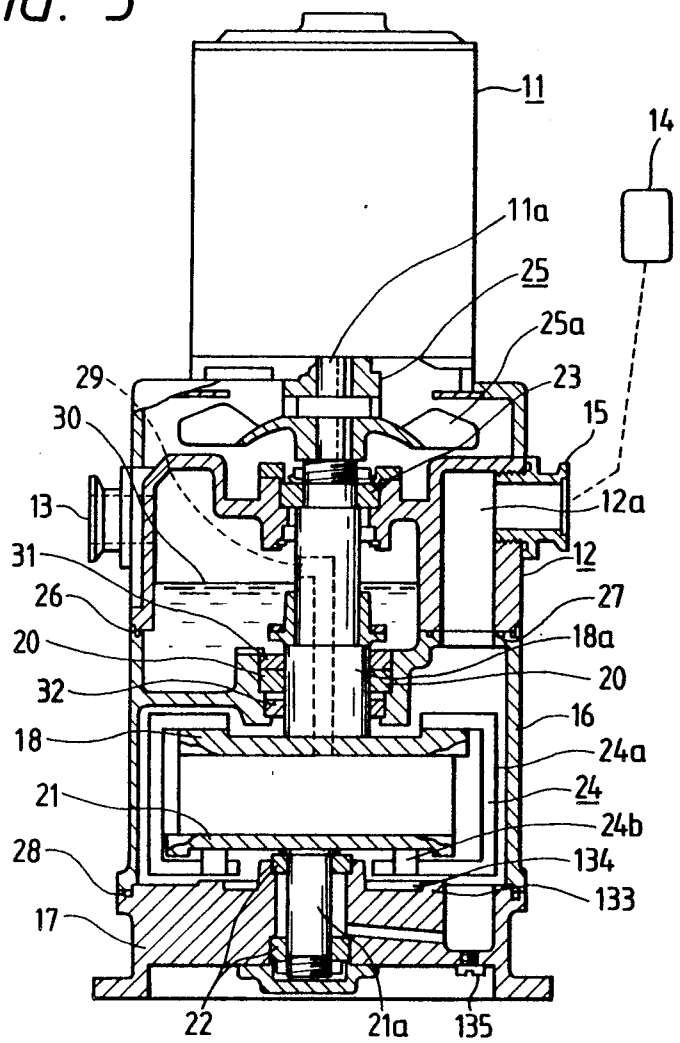
FIG. 3 shows a longitudinally sectional view of a scroll fluid machine which is another embodiment of the present invention.

FIG. 3 shows a scroll fluid machine which is another one of the embodiments. The difference of the machine from that shown in FIG. 2 is that the top of a base 17 has an annular wall 133 extending near an Oldham coupling 24 and surrounding a shallow annular oil storage recess 134. Lubricating oil 30 remaining on the top of the base 17 and being moved outward in the circumferential direction thereof due to the rotation of the Oldham coupling 24 is surely stopped by the annular wall 133 so that the oil is accumulated in the oil storage recess 134. Since the wall 133 is provided near the coupling 24, an oil film is kept between them to lubricate the sliding portions of the central and peripheral members **24*b* and 24*a*** of the coupling.

Figure 4:
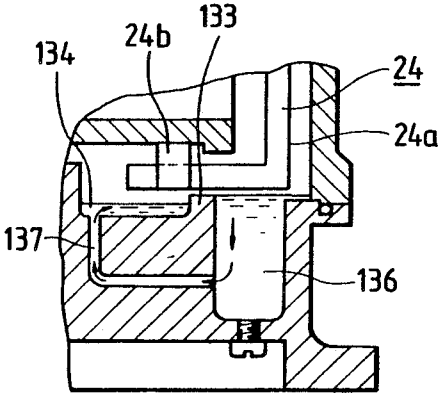
FIG. 4 shows a longitudinally sectional view of a major part of a scroll fluid machine which is yet another embodiment of the present invention.

FIG. 4 shows a major part of a fluid scroll machine which is yet another one of the embodiments. The difference of the machine from that shown in FIG. 2 is that the top of a base 17 has an annular wall 133 extending near an Oldham coupling 24 and surrounding a shallow annular oil storage recess 134, and the base has an annular oil sump 136 extending around the wall and deeper than the oil storage recess, and an oil passage 137 connecting the lower portion of the oil sump to the bottom off the oil storage recess. Since the level of lubricating oil in the oil sump 136 is made higher than that of lubricating oil in the oil storage recess 134 due to the rotation of the central and peripheral members **24*b* and 24*a* of the Oldham coupling 24, a pressure difference is produced so that the oil in the sump circulates to the recess through the oil passage 137. For that reason, the lubricating oil is surely supplied to the oil storage recess 134**.

Figure 5:
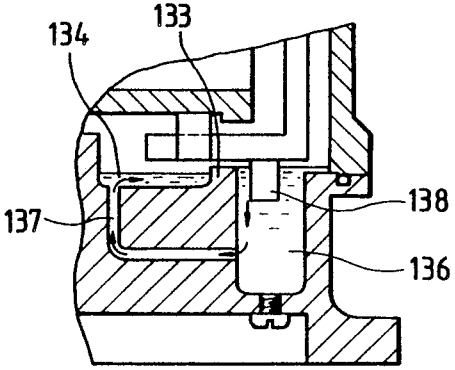
FIG. 5 shows a longitudinally sectional view of a major part of a scroll fluid machine which is yet another embodiment of the present invention.

FIG. 5 shows a major part of a fluid scroll machine which is yet another one of the embodiments. The difference of the machine from that shown in FIG. 4 is that an annular guide projection 138 is provided on the peripheral member **24*a* of an Oldham coupling 24 and extends down from the bottom of the member into an oil sump 136. The guide projection 138 acts so that lubricating oil coming to the projection over an annular wall 133 is guided downward. For that reason, the lubricating oil is enabled to easily circulate through a shallow oil storage recess 134, the oil sump 136 and an oil passage 137. Even if the lubricating oil in the oil storage recess 134 is flown away outward, the oil is stopped by the guide projecting 138 and flows down thereon so that the oil circulates through the oil sump 136, the oil passage 137 and the oil storage recess 134**.

What is claimed is:

1. A scroll fluid machine comprising:

a casing, having upper and lower portions, said lower portion comprising a bottom portion;

an upper scroll and a lower scroll, each of said upper and lower scrolls being provided rotatably about a respective vertical axis and being disposed within said casing, said scrolls being supported for eccentric rotation with respect to each other;

a coupling comprising a central member and a peripheral member, said central member being provided under said lower scroll at a position extended radially from said lower scroll axis and proximate to but above said casing bottom portion, and said peripheral member being provided at said upper scroll and being joined to said central member;

an oil storage recess provided within said bottom portion of said casing at a position proximate to said central member and facing said central member;

an annular wall extending up from said bottom portion of said casing and disposed inside of said casing at a position extended radially from said lower scroll axis; and an oil sump means, having a bottom lower than said oil recess, provided at a position extended radially from said lower scroll axis that is beyond the position of said annular wall.

2. A scroll fluid machine according to claim 1 further comprising a first oil passage providing oil communication between said oil storage recess and said oil sump means.

3. A scroll fluid machine according to the claim 1 wherein said annular wall is located at a position extended radially from said lower scroll axis that is beyond said oil storage recess.

4. A scroll fluid machine according to the claim 1 further comprising an annular guide projection from and extending below the bottom of the peripheral member of said coupling into said oil sump.

5. A scroll fluid machine as set forth in claim 1, wherein said coupling comprises an Oldham coupling which connects said scrolls to each other.

6. A scroll fluid machine according to claim 5 wherein said casing comprises a boss and a bearing means, and an opening is defined between said boss of the casing and said bearing means, by which the lower scroll is rotatably supported, and said machine further comprises an oil passage, through which said opening and said oil sump communicate with each other.

* * * * *